US011155892B2

(12) United States Patent
Teipel et al.

(10) Patent No.: US 11,155,892 B2
(45) Date of Patent: Oct. 26, 2021

(54) METHOD FOR PRODUCING A STAINLESS STEEL SHEET WITH MODIFIED VISUAL CHARACTERISTICS

(71) Applicant: Outokumpu Oyj, Helsinki (FI)

(72) Inventors: Jörn Teipel, Cologne (DE); Dirk Wiemer, Dusseldorf (DE); Lutz Zoppke, Hungen (DE); Patrick Vogel, Gladenbach (DE); Andreas Jääger, Dillenburg (DE); Michael Weg, Dietzholztal (DE); Burkhard Arnold, Dillenburg (DE); Frank Wörster, Netphen (DE)

(73) Assignee: Outokumpu Oyj, Helsinki (FI)

( * ) Notice: Subject to any disclaimer, the term of this patent is extended or adjusted under 35 U.S.C. 154(b) by 233 days.

(21) Appl. No.: 15/575,102

(22) PCT Filed: May 18, 2016

(86) PCT No.: PCT/EP2016/061100
§ 371 (c)(1),
(2) Date: Nov. 17, 2017

(87) PCT Pub. No.: WO2016/184891
PCT Pub. Date: Nov. 24, 2016

(65) Prior Publication Data

US 2018/0148810 A1 May 31, 2018

(30) Foreign Application Priority Data

May 18, 2015 (EP) ..... 15167926

(51) Int. Cl.

| | |
|---|---|
| ***C21D 9/46*** | (2006.01) |
| ***B21B 1/22*** | (2006.01) |
| ***B21B 3/02*** | (2006.01) |
| ***C21D 6/00*** | (2006.01) |
| ***C21D 8/02*** | (2006.01) |
| ***C21D 1/26*** | (2006.01) |

(52) U.S. Cl.
CPC ..... *C21D 9/46* (2013.01); *B21B 1/227* (2013.01); *B21B 3/02* (2013.01); *C21D 1/26* (2013.01); *C21D 6/002* (2013.01); *C21D 8/0205* (2013.01); *C21D 8/0236* (2013.01); *C21D 8/0247* (2013.01); *C21D 8/0278* (2013.01); *C21D 2211/001* (2013.01); *C21D 2211/005* (2013.01)

(58) Field of Classification Search
None
See application file for complete search history.

(56) References Cited

U.S. PATENT DOCUMENTS

| | | | | |
|---|---|---|---|---|
| 3,556,874 | A | 1/1971 | McClain | |
| 5,709,759 | A * | 1/1998 | Ljungars | C21D 8/0205 148/645 |
| 5,830,291 | A * | 11/1998 | McGuire | C21D 8/0205 148/610 |
| 6,072,117 | A * | 6/2000 | Matsuyama | H01L 31/022466 136/256 |
| 2011/0293464 | A1* | 12/2011 | Abratis | C21D 8/0426 420/42 |
| 2013/0337289 | A1* | 12/2013 | Hatano | C22C 38/001 428/685 |
| 2014/0017517 | A1 | 1/2014 | Kawagoe et al. | |
| 2015/0336143 | A1 | 11/2015 | Krautschick et al. | |

FOREIGN PATENT DOCUMENTS

| | | | |
|---|---|---|---|
| CN | 102925649 | A | 2/2013 |
| EP | 2692452 | A1 | 2/2014 |
| JP | 6182401 | A | 7/1994 |
| JP | 2974597 | B2 | 11/1999 |
| JP | 2000144257 | A | 5/2000 |
| JP | 2011110594 | A | 6/2011 |
| KR | 20010065235 | A | 7/2001 |
| KR | 1020120059970 | A | 6/2012 |
| WO | 2014096180 | A1 | 6/2014 |

OTHER PUBLICATIONS

J-PlatPat translation of JPH06182401 (Year: 2019).*

* cited by examiner

*Primary Examiner* — Patricia L. Hailey
*Assistant Examiner* — Christopher D. Moody
(74) *Attorney, Agent, or Firm* — The Webb Law Firm

(57) ABSTRACT

The invention relates to a method for producing a patterned stainless steel sheet with modified visual characteristics in the wavelength area of visible light the deformed stainless steel having a thickness of 0.3-3.5 mm. In the method the deformed stainless steel sheet is pretreated by at least one heat treatment step and at least one mechanical treatment step on at least one surface of the heat treated stainless steel sheet. The pretreated stainless steel sheet is further transferred to a patterning process, and at least one heat treatment step is carried out on the patterned stainless steel sheet surface.

12 Claims, No Drawings

METHOD FOR PRODUCING A STAINLESS STEEL SHEET WITH MODIFIED VISUAL CHARACTERISTICS

CROSS-REFERENCE TO RELATED APPLICATIONS

This application is the United States national phase of International Application No. PCT/EP2016/061100 filed May 18, 2016, and claims priority to European Patent Application No. 15167926.3 filed May 18, 2015, the disclosures of which are hereby incorporated in their entirety by reference.

BACKGROUND OF THE INVENTION

Field of the Invention

The present invention relates to a method for producing a patterned stainless steel sheet with modified visual characteristics in the wavelength area of visible light, such as low reflectance and low glare with the inherent sparkle of the stainless steel being at least maintained.

DESCRIPTION OF RELATED ART

It is common that the surface of a stainless steel sheet is made to have good visual characteristics. For instance the CN publication 102925649 describes a manufacture method of austenitic stainless steels with good polishing performance wherein the austenitic stainless steel is treated by carrying-out hot rolling, carrying out hot-rolling annealing, carrying out acid washing after hot-rolling annealing, carrying out cold-rolling, carrying out cold-rolling annealing, carrying out acid washing after cold-rolling annealing and refining in order to have a decorative sheet.

The object of the JP publication 2000144257 is to improve the gloss of a stainless steel surface. The manufacture method of the JP publication 2000144257 comprises a cold rolling process of the austenitic stainless steel strip and further a bright annealing process so that the grain size of the stainless steel strip is 0.0134-0.027 mm. After bright annealing the strip is temper rolled and pressed, and an electrolytic polishing process is carried out for the pressed product which is further treated in order to improve the gloss of the surface by eliminating fine unevenness of the surface and achieving the smoothness and mirror polishing of the surface.

The JP publication 2011110594 relates to a method for manufacturing a cold-rolled ferritic stainless steel strip excellent in surface gloss. The surface finish applying cold rolling, annealing or further pickling is performed by temper rolling with the rolls which are ground to the average roughness Ra of 0.003-0.010 micrometers in the roll width direction after applying chromium plating to the surfaces of the steel rolls and thus without lubrication.

In the CN publication 102925649, in the JP publication 2000144257 and in the JP publication 2011110594 a separate washing, polishing or plating process step is required in order to achieve the final product of the method.

The KR publication 20120059970 describes a manufacturing process for ferritic stainless steel which method includes an annealing process, the following temper roll mill process, surface finishing and multi-stage shape correcting process. The glossiness of the ferritic stainless steel at the light reflection angle of 60 degrees is controlled to the range of 150-420. The multi-stage shape correcting process makes this manufacturing process more complicated and thus the manufacturing costs are high.

The US publication 2014017517 relates to a stainless steel plate which is manufactured by performing temper rolling using a dull roller after the finish cold rolling and bright annealing. After the last temper rolling, the plate may also be passed through degreasing and refining processes such as a tension leveler and slit to the extent that the surface properties are not affected. The total cold rolling ratio until bright annealing was set 70% or more. The stainless steel plate is applicable as exterior building material, interior building material, automotive steel plate, commercial kitchen equipment, outer plate for home appliances, outer plate for kitchen equipment and kitchen accessories, and precision equipment components and electronic device components such as computer members, digital equipment members, HDD (hard disk drive) members and solar cell substrate material.

According to the US publication 2014017517 the washability is improved by controlling the micro-pits that are the cause of adherence of dirt, and temper rolling is performed under conditions in which the opening and occurrence of micro-pits are restrained. Therefore, it is possible to improve the anti-glare property while maintaining washability. The object of this US publication 2014017517 is thus to keep the plate as even as possible and, therefore, there are no decorative structures, such as patterns, on the surface of the plate.

The JP patent application H06-182401 relates to a manufacturing method of a dull finishing stainless steel plate in which method after cold rolling and annealing and pickling, light rolling is carried out with a dull roll and then further annealed and pickled. Instead of annealing and pickling bright annealing can be carried out. Any patterning of the material is not described, but only an anti-dazzle surface.

SUMMARY OF THE INVENTION

The object of the present invention is to eliminate some drawbacks of the prior art and to establish a method for producing a patterned stainless steel sheet with modified visual characteristics in the wavelength area of visible light, such as low reflectance and low glare but remaining the inherent sparkle of the stainless steel and liveliness. The essential features of the invention disclosed herein.

According to the present invention the material for the method is first cold deformed, such as cold rolled, in order to have a stainless steel sheet having a desired reduction degree and thus a desired thickness range of 0.32-3.5 mm for further process steps. The cold deformed stainless steel sheet is pretreated by at least one heat treatment step and at least one mechanical treatment step, before the stainless steel sheet is transferred into a mill for patterning. After patterning operation further at least one heat treatment step is carried out for the patterned stainless steel sheet before refining the sheet for the final product having the desired surface properties with visual characteristics in the wavelength area (380-800 nanometre) of visible light, such as low reflectance and low glare as well as the inherent sparkle of the stainless steel.

The deformed stainless steel sheet is heat treated before the patterning treatment at the temperature range of 900-1200° C., preferably at the temperature range of 1050-1200° C. The heat treatment for the deformed stainless steel sheet is carried out as an annealing and pickling step or as a bright annealing step.

The heat treated stainless steel sheet is further treated mechanically on at least one surface of the heat treated stainless steel sheet before the patterning operation. The mechanical treatment before patterning is advantageously carried out by skin-pass rolling with a dull roll or by blasting process in order to have matt blasted surface.

During the patterning operation, a pattern device, such as a roll, is advantageously used at least on the surface of the stainless steel sheet mechanically treated in order to carry out the patterning process of a desired design onto the surface of the stainless steel sheet. When the patterning operation is only focussed on one surface of the stainless steel sheet a smooth roll is utilized on the opposite side. The emboss depth on the side of the pattern device, such as a roll, is up to 100 micrometre.

The patterned stainless steel sheet is further heat treated at the temperature range of 900-1200° C., preferably at the temperature range of 1050-1200° C. by carrying out the heat treatment as an annealing and pickling operation or as a bright annealing operation. After the heat treatment the patterned stainless steel sheet can be used as a final product of the method. It is also possible that the heat treated patterned stainless steel sheet is refined, such as tension levelled, in order to have for instance a desired flatness, before the sheet in accordance with the method of the invention is ready as a final product.

The stainless steel sheet treated according to the method of the invention shows a superior surface homogeneity and has slightly matt but sparkling on each of nuggets of the surface. The surface shows a lower or equal specular reflectance than the value of less than 25% in the prior art, because due to higher sparkling together with the homogeneity of the surface this characteristic is achieved.

The stainless steel sheet treated according to the method of the invention further shows a specular reflectance of less than 10% in the visible wavelength range, but still shows a sparkling, lively appearance. These desired properties can be achieved when in connection with the heat treatment for the deformed sheet a mechanical blasting process is carried out in order to have a very matt blasted surface on which patterns are formed during the patterning process step.

The skin-pass rolling for the deformed and heat treated stainless steel sheet before the patterning operation can advantageously be carried out with a textured roll. The skin-pass rolling achieves a roughness Ra of 0.5-2.5 micrometers for the surface which leads to a lower reflectance of the final product and due to the additional texture on the surface in order to increase sparkling in the final product of the method according to the invention.

The method for producing a patterned stainless steel sheet according to the invention is advantageously at least at intervals continuous, preferably essentially constantly continuous. Therefore, the deformed stainless steel sheet having the desired thickness can be transferred through all the process steps continuously that means lower manufacturing costs and uniform quality, such as homogeneity of the surface for the final product.

The stainless steel sheet to be used in the method of the invention can be austenitic stainless steel, ferritic stainless steel or ferritic austenitic stainless steel. The stainless steel sheet treated in accordance with the method of the present invention is applicable as exterior building material, interior building material, automotive steel plate, commercial kitchen equipment, outer plate for home appliances, outer plate for kitchen equipment and kitchen accessories.

The invention claimed is:

1. A method for producing a patterned stainless steel sheet with improved visual characteristics in the wavelength area of visible light, the method comprising:

providing a deformed stainless steel sheet having a thickness of 0.3-3.5 mm;

pretreating the deformed stainless steel sheet by heat treating the deformed stainless steel sheet at a temperature of 900-1200° C. in an annealing and pickling process or a bright annealing process and subjecting the annealed and pickled or bright annealed stainless steel sheet to skin pass rolling with a textured roll to provide at least one surface of the pretreated sheet with a surface roughness of 0.5-2.5 micrometers;

transferring the pretreated stainless steel sheet to a patterning process;

patterning at least one side of the pretreated stainless steel sheet with a patterning roll, where the emboss depth of the pattern is up to 100 micrometers; and heat treating the patterned stainless steel sheet at a temperature of 900-1200° C., wherein the patterned stainless steel sheet has a specular reflectance of less than or equal to 25%.

2. The method according to claim 1, wherein the heat treatment for the deformed stainless steel sheet is carried out at a temperature of 1150-1200° C.

3. The method according to claim 1, wherein the patterning process is carried out at least on the surface of the stainless steel skin pass rolled before patterning.

4. The method according to claim 1, wherein the heat treatment for the patterned stainless steel sheet is carried out as an annealing and pickling process.

5. The method according to claim 1, wherein the heat treatment for the patterned stainless steel sheet is carried out as a bright annealing process.

6. The method according to claim 1, further comprising tension levelling the heat treated patterned stainless steel sheet.

7. The method according to claim 1, wherein the deformed stainless steel sheet is made of austenitic stainless steel.

8. The method according to claim 1, wherein the deformed stainless steel sheet is made of ferritic stainless steel.

9. The method according to claim 1, wherein the deformed stainless steel sheet is made of ferritic austenitic stainless steel.

10. The method according to claim 1, wherein the patterned stainless steel sheet is applicable as exterior building material, interior building material, automotive steel plate, commercial kitchen equipment, outer plate for home appliances, outer plate for kitchen equipment and kitchen accessories.

11. The method according to claim 1, wherein the heat treatment for the patterned stainless steel sheet is carried out at the temperature range 1150-1200° C.

12. The method according to claim 1, where the specular reflectance is less than 10%.

* * * * *